US006039063A

United States Patent [19]

Lin et al.

[11] Patent Number: 6,039,063

[45] Date of Patent: Mar. 21, 2000

[54] MULTIPLE-FOLD WINDPROOF UMBRELLA FOR PREVENTING SAGGING OF UMBRELLA CLOTH

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 09/407,079

[22] Filed: Sep. 28, 1999

Related U.S. Application Data

[63] Continuation-in-part of application No. 09/197,482, Nov. 20, 1998.

[51] Int. Cl.[7] ..... A45B 25/20

[52] U.S. Cl. ..... 135/33.7; 135/32; 135/29; 135/25.31

[58] Field of Search ..... 25/15.1, 25.1, 25/25.31, 29, 31, 32, 33.2, 33.4, 33.7, 98; 403/85

[56] References Cited

U.S. PATENT DOCUMENTS

| | | | |
|---|---|---|---|
| 212,457 | 2/1879 | Girbardt | 135/33.7 |
| 1,027,426 | 5/1912 | McClellaw | 135/32 |
| 1,652,667 | 12/1927 | Greenberg | 135/33.2 X |
| 3,960,162 | 6/1976 | Noel | 135/33.7 |
| 4,794,939 | 1/1989 | Okuda | 135/33.2 X |
| 4,865,063 | 9/1989 | Williams | 135/33.7 |
| 4,979,534 | 12/1990 | Johnson et al. | 135/33.7 |
| 5,078,166 | 1/1992 | Lee | 135/33.7 |
| 5,115,827 | 5/1992 | Lee | 135/33.7 |
| 5,601,103 | 2/1997 | Dubinsky | 135/33.7 |

*Primary Examiner*—Carl D. Friedman
*Assistant Examiner*—Winnie Yip
*Attorney, Agent, or Firm*—Dougherty & Troxell

[57] ABSTRACT

A multiple-fold windproof umbrella includes: a central shaft having a rib assembly pivotally secured to the central shaft, a lower cloth having an anti-sagging band fastened on an upper periphery of the lower cloth and secured to the rib assembly, an upper cloth secured to the central shaft and juxtapositionally retained above the lower cloth, and a plurality of control valves each formed between the upper cloth and the lower cloth secured on the rib assembly, with the valves opened for escaping a strong wind blowing into the umbrella cloths; and automatically restoring the upper cloth downwardly for closing the opening between the upper and lower cloths of the umbrella after the escape of wind; with the anti-sagging band provided on the lower cloth automatically tensioning the upper periphery of the lower cloth for preventing the sagging of the lower cloth and for enhancing a smooth folding and unfolding of the umbrella.

4 Claims, 4 Drawing Sheets

MULTIPLE-FOLD WINDPROOF UMBRELLA FOR PREVENTING SAGGING OF UMBRELLA CLOTH

This application is a continuation-in-part (C-I-P) of applicant's parent application of U.S. Ser. No. 09/197,482 filed on: Nov. 20, 1998.

BACKGROUND OF THE INVENTION

The parent application disclosed a multiple-fold windproof umbrella having valves openable for escaping strong wind blowing into the umbrella cloths and automatically restored for closing the opening between the upper and lower cloths after the escape of wind. A net member 3*a* is provided to secure the lower cloth towards the central shaft for a uniform stress distribution on the net member and the lower cloth. Such a net member will increase the installation complexity since the net member 3*a* should pass through every base portion 41 of each control valve 4, thereby increasing the production cost of the umbrella.

If the net member 3*a* is eliminated as shown in FIG. 8 as attached in this application, the lower umbrella cloth 3 may be sagged (S) when folding the umbrella, thereby causing tangling of the lower and the upper cloths 3, 5 and obstructing a smooth unfolding and folding operation of the umbrella.

The present inventor has found the drawbacks of the parent application and invented the present multiple-fold windproof umbrella for preventing sagging of umbrella cloth.

SUMMARY OF THE INVENTION

The object of the present invention is to provide a multiple-fold windproof umbrella including: a central shaft having a rib assembly pivotally secured to the central shaft, a lower cloth having an anti-sagging band fastened on an upper periphery of the lower cloth and secured to the rib assembly, an upper cloth secured to the central shaft and juxtapositionally retained above the lower cloth, and a plurality of control valves each formed between the upper cloth and the lower cloth secured on the rib assembly, with the valves opened for escaping a strong wind blowing into the umbrella cloths; and automatically restoring the upper cloth downwardly for closing the opening between the upper and lower cloths of the umbrella after the escape of wind; with the anti-sagging band provided on the lower cloth automatically tensioning the upper periphery of the lower cloth for preventing the sagging of the lower cloth and for enhancing a smooth folding and unfolding of the umbrella.

DETAILED DESCRIPTION

Figures 1, 2:
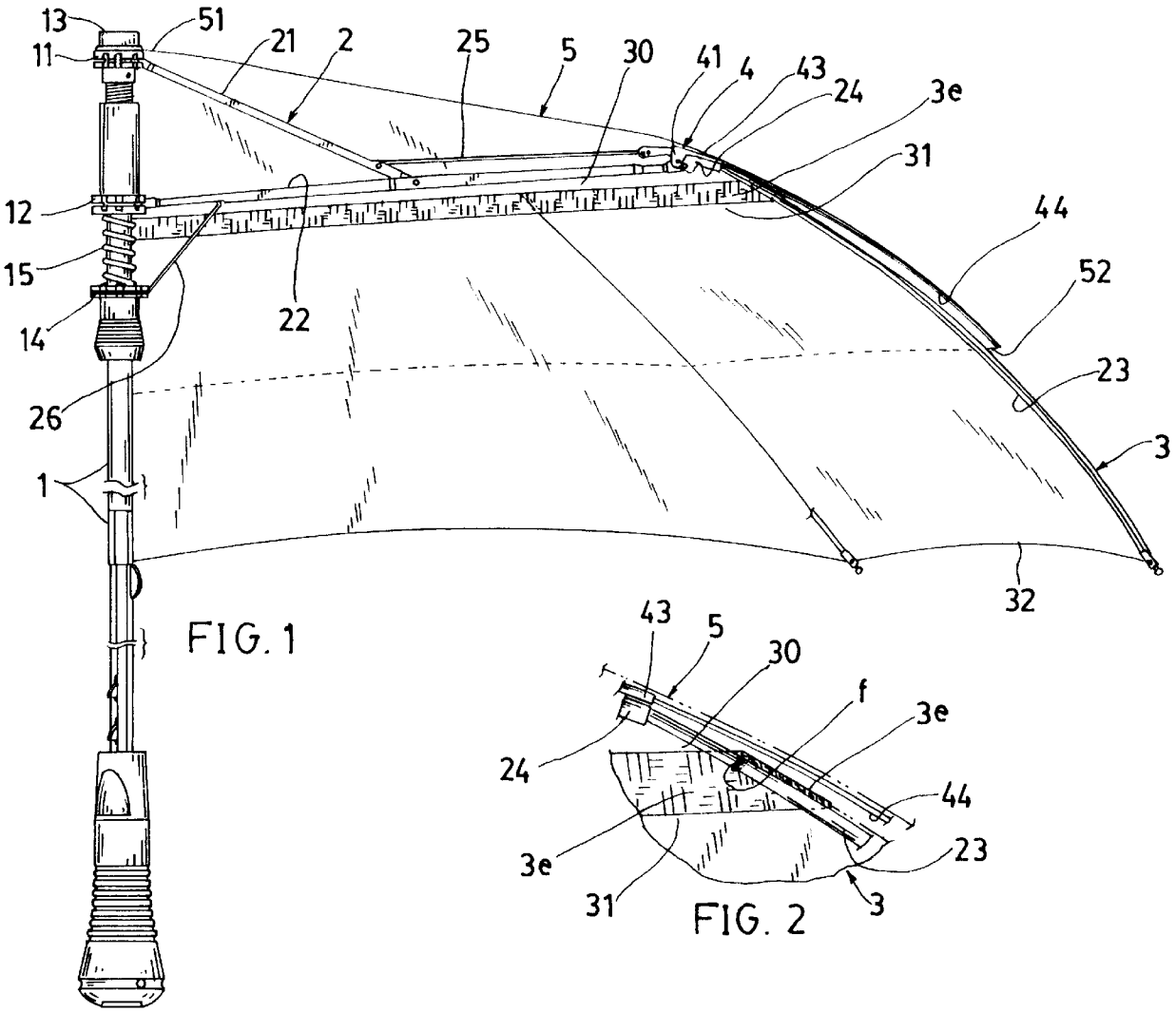
FIG. 1 is an illustration showing an opened umbrella of the present invention.
FIG. 2 is a partial enlarged view from FIG. 1 showing the anti-sagging band secured on the rib assembly of the present invention.

As shown in FIGS. 1~7, a multiple-fold windproof umbrella of the present invention comprises: a central shaft 1, a rib assembly 2 pivotally secured to the central shaft 1, a lower cloth 3 secured to the rib assembly 2, an anti-sagging band 3*e* connected or fastened on an upper peripheral portion 31 of the lower cloth 3 and secured on the rib assembly 2 by fasteners f, a plurality of control valves 4 each formed or secured on the rib assembly 2, and an upper cloth 5 secured to the central shaft 1 and secured on each control valve 4 which controls the opening or closing of an annular opening O formed by wind blowing through an aperture or air passage between the upper and lower cloths 5, 3.

The rib assembly 2 includes: a top rib 21 pivotally secured to an upper notch 11 of the central shaft 1, a stretcher rib 22 pivotally secured to a lower runner 12 slideably held on the central shaft 1 and also secured with an outer portion of the top rib 21, an outer rib 23 secured to a joint member 24 which is pivotally secured to an outer portion of the stretcher rib 22 and also pivotally secured to the top rib 21 through a connecting rib 25, and an auxiliary rib 26 pivotally connected between the stretcher rib 22 and a lowest runner 14 slideably held on the shaft 1, having an opening spring 15 tensioned between the lower runner 12 and the lowest runner 14 for opening the umbrella, thereby forming an automatic opening umbrella.

Naturally, the lowest runner 14 and the spring 15 may be omitted to be a manually opening umbrella.

The lower cloth 3 has the upper peripheral portion 31 secured to the anti-sagging band 3*e* which is fastened to the rib assembly especially fastened on the outer rib 23, and a lower peripheral portion 32. The anti-sagging band 3*e* may also be secured to the joint member 24 of the rib assembly 2.

A central opening 30 is formed between the anti-sagging band 3*e* and the upper notch 11 of the shaft 1, with the central opening 30 communicated with the annular opening 0 between the upper cloth 5 and the lower cloth 3.

The anti-sagging band 3*e* may be made of stretchable elastic tape or strip by weaving rubber cords with a fabric strip, or a fabric strip having suitable elasticity or toughness.

Figure 5:
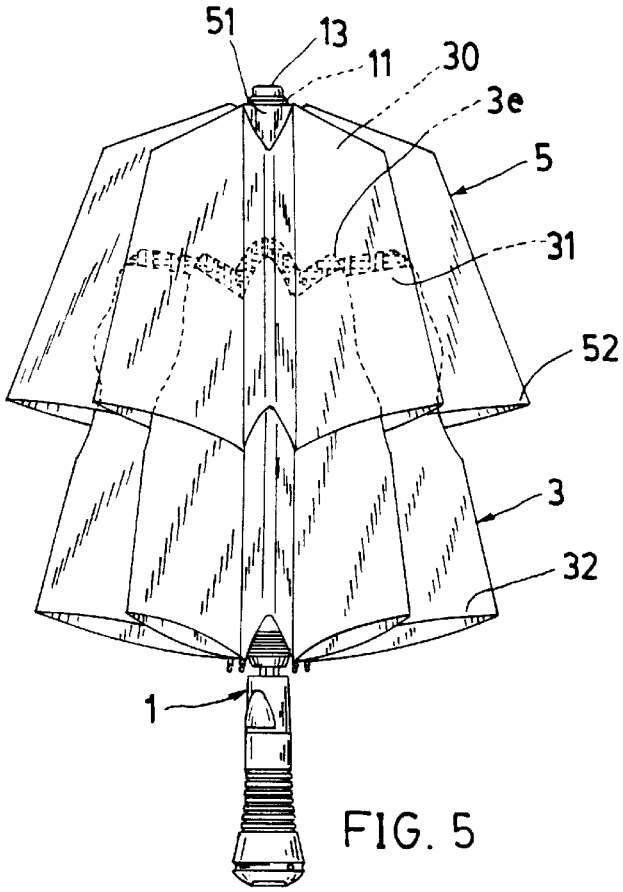
FIG. 5 shows a folded umbrella of the present invention.
Figure 6:
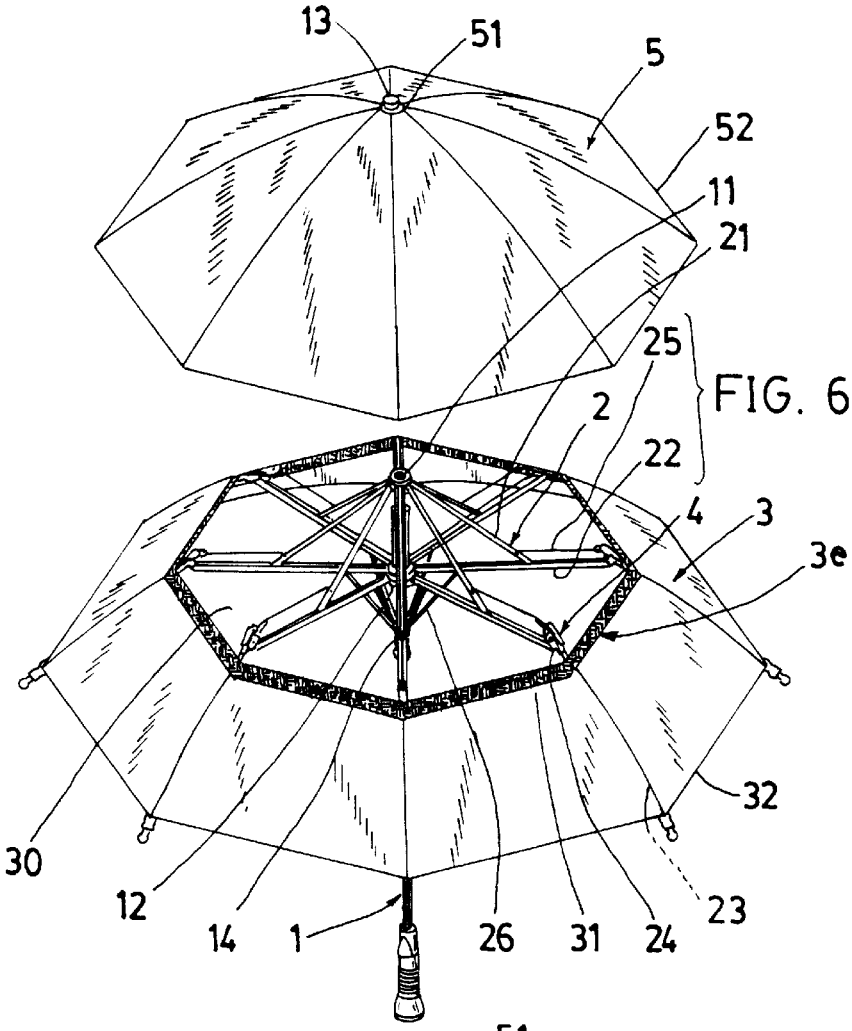
FIG. 6 is an exploded view showing the upper cloth and the lower cloth of the present invention.
Figure 7:
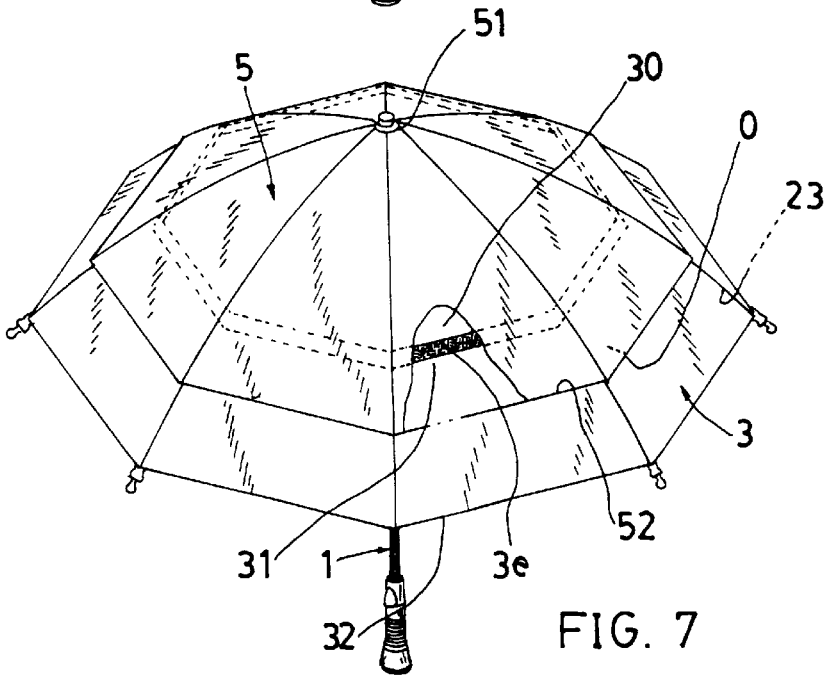
FIG. 7 is a perspective view of the present invention.
Figure 8:
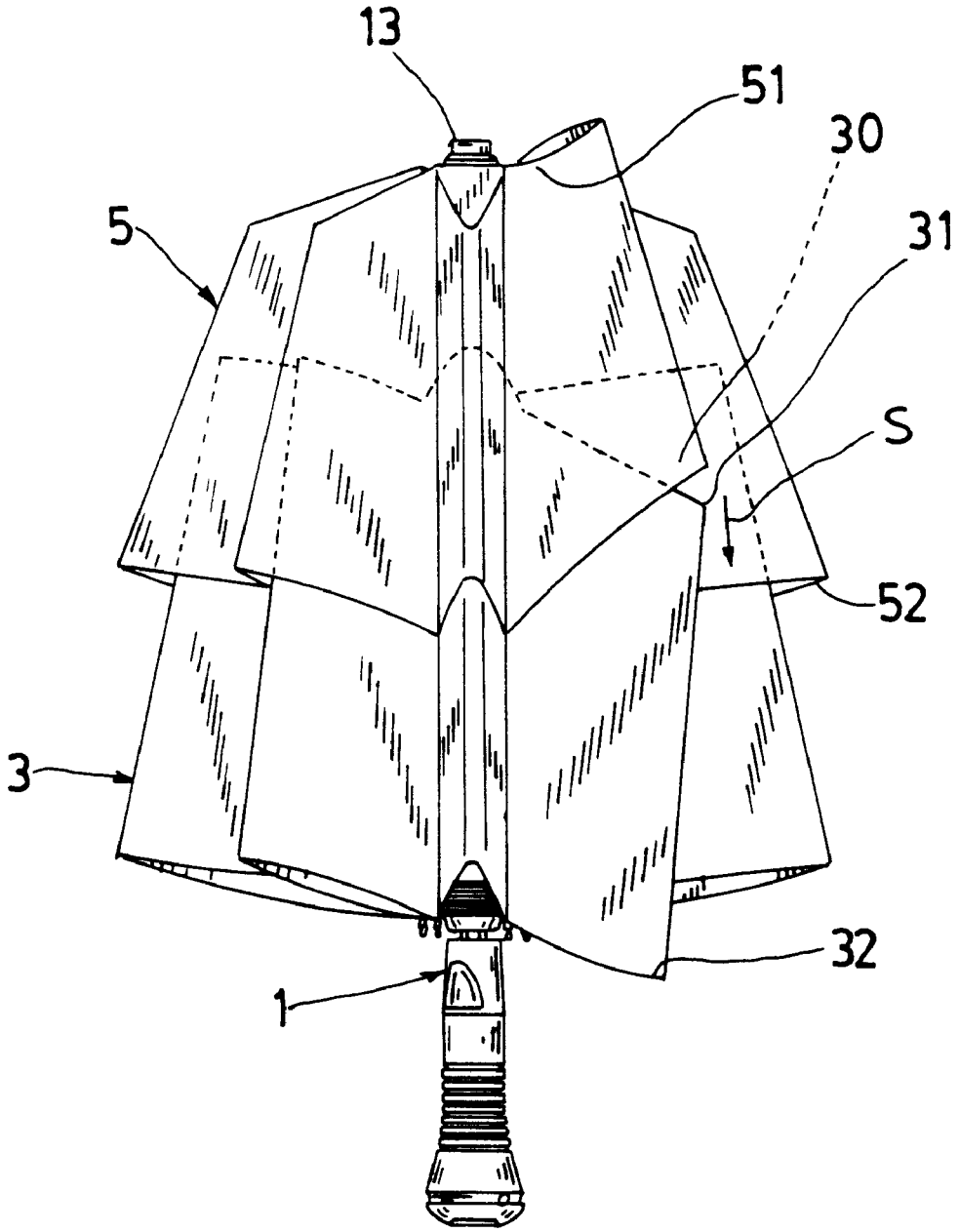
FIG. 8 PRIOR ART
FIG. 8 is a prior art showing a folded umbrella when a net member secured between the lower cloth and the central shaft has been eliminated.

The anti-sagging band 3*e* is secured on the outer ribs 23 by fasteners "f" such as by threads sewn on the ribs 23 or by other suitable fastening materials, not limited in the present invention. The anti-sagging band 3*e* preferably has an elastic property to be stretchable tensioned (without sagging) among the outer ribs 23 of the rib assembly 2 when opening the umbrella. The band 3*e* may shrink itself due to its elasticity when closing the umbrella for preventing sagging of the upper peripheral portion 31 of the lower cloth 3 as shown in FIG. 5, thereby preventing tangling of the upper and the lower cloths 5, 3 during the folding and unfolding operation of the umbrella.

The upper cloth 5 has a central portion 5 1 secured to the upper notch 11 and retained on the notch 11 by a cap 13 fixed on a top end of the central shaft 1, and an outer peripheral portion 52 secured to the control valve 4.

Figure 3:
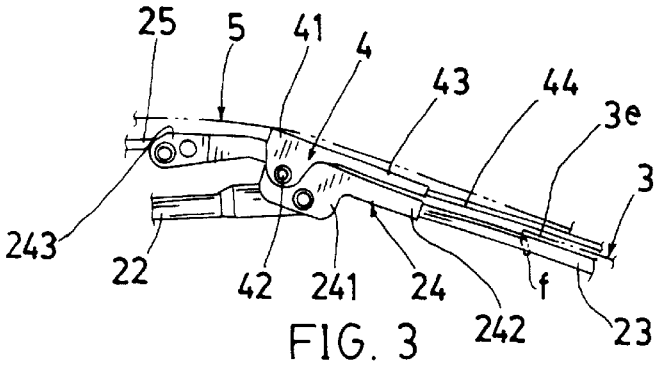
FIG. 3 shows a closed control valve of the present invention.
Figure 4:
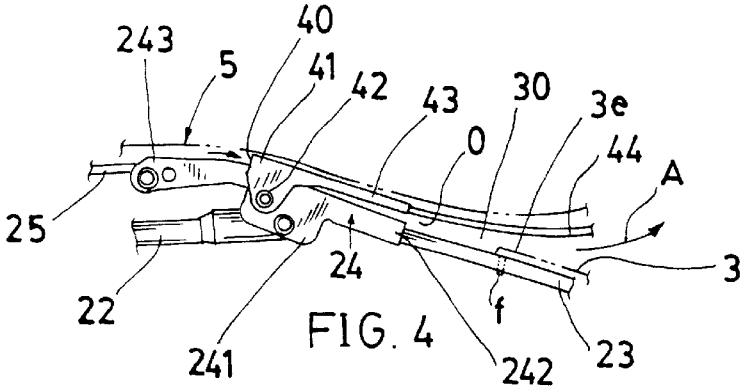
FIG. 4 shows an opened control valve of the present invention.

Each joint member 24 of the rib assembly 2 as shown in FIGS. 1, 3 and 4 includes a lug portion 241 for pivotally connecting an outer portion of the stretcher rib 22, an outer portion 242 for connecting the outer rib 23, and an inner portion 243 for connecting an outer portion of the connecting rib 25, of which the inner portion is connected to the top rib 21.

Each control valve 4 includes: a base portion 41 connected to the joint member 24 by a pivot 42; an air inlet port 40 defined between the base portion 41 and the joint member 24 for directing wind or air A outwardly through the opening O formed between the upper cloth 5 and the lower cloth 3 as shown in FIGS. 4; a sleeve portion 43 protruding outwardly from the base portion 41; and a restoring spring member 44 engaged in the sleeve portion 43 when an inner end of the spring member 44 is inserted into a socket recessed in the sleeve portion 43, with an outer end of the spring member 44 connected with the outer peripheral portion 52 of the upper cloth 5 such as by stitching or sewing.

The restoring spring member 44 may be an elongate spring plate or may be a spring rod, not limited in this invention.

When an opened umbrella of the present invention is subjected to a strong wind, the air A will blow through the inlet port 40 to open the control valve 4 and the opening O between the upper and lower cloths 5, 3 to be escaped therethrough. At this time, the sleeve portion 43 and the spring member 44 of the control valve 4 are biased upwardly to open the opening O between the upper and lower cloths 5, 3 (FIG. 4). After the wind is escaped, the resilience of the spring member 44 will restore the spring member 44 to automatically close the upper cloth 5 on the lower cloth 3 (FIG. 3).

The anti-sagging band 3*e* of the present invention provides a suitable elasticity or even self-shrinking property for preventing sagging of the upper peripheral portion 31 of the lower cloth 3 especially when the umbrella is closed (FIG. 5), thereby preventing mutual tangling or obstruction between the upper cloth 5 and the lower cloth 3 and enhancing a smooth folding and unfolding operation of the umbrella.

When opening the umbrella, the anti-sagging band 3*e* provided on the upper peripheral portion 31 of the lower cloth 3 will also tension the lower cloth 3 to be stably loaded on the ribs 23 of the rib assembly for stably holding the upper peripheral portion 31 of the lower cloth 3 without sagging.

Since the net member 3*a* of the parent application has now been eliminated, the production cost of the present invention may be decreased and the total weight of the umbrella may also be decreased for a more convenient carrying or storing purpose.

The present invention may be modified without departing from the spirit and scope of the present invention.

We claim:

1. A multiple-fold windproof umbrella comprising:

a central shaft;

a rib assembly having at least a top rib pivotally secured to an upper notch formed on a top portion of the central shaft, a stretcher rib pivotably connected between a lower runner slideably held on the central shaft and an outer rib; with said stretcher rib pivotally connected with said top rib;

a lower cloth secured on the rib assembly and having an upper peripheral portion of said lower cloth connected with an anti-sagging band which is fastened on the rib assembly; a central opening defined between said anti-sagging band and said upper notch of said central shaft; said anti-sagging band having elasticity to be stably held on said rib assembly without sagging of said upper peripheral portion of said lower cloth from said rib assembly;

an upper cloth secured to the upper notch of the central shaft and juxtapositioned above said lower cloth and said anti-sagging band; and a plurality of control valves each control valve formed between the upper cloth and said rib assembly, having an annular opening defined between said upper cloth and said lower cloth, said annular opening communicated with said central opening in said anti-sagging band;

said control valve normally resiliently restoring said upper cloth to approximate said lower cloth to close said annular opening defined between said upper cloth and said lower cloth;

whereby upon blowing of a strong wind, each said control valve will be opened to open the annular opening between the upper and lower cloths to escape the wind; and upon escape of the wind, each said control valve will automatically restore to close said upper cloth on said lower cloth for closing the annular opening between said upper and lower cloths.

2. A multiple-fold windproof umbrella according to claim 1, wherein said anti-sagging band is a stretchable elastic tape connected with said upper peripheral portion of said lower cloth, and fastened to said outer rib of said rib assembly.

3. A multiple-fold windproof umbrella according to claim 1, wherein said anti-sagging band is a fabric strip connected to said upper peripheral portion of said lower cloth fastened on said outer rib of said rib assembly.

4. A multiple-fold windproof umbrella according to claim 1, wherein said rib assembly further includes a connecting rib pivotally connected between said top rib and said outer rib, an auxiliary rib pivotally connected between said stretcher rib and a lowest runner slideably held on said central shaft below said lower runner, and an opening spring tensioned between said lower runner and said lowest runner for automatically opening the umbrella.

* * * * *